United States Patent [19]

Zurbuchen et al.

[11] 4,255,154

[45] Mar. 10, 1981

[54] PROCESS FOR THE LEVEL DYEING OF POLYESTER MATERIAL

[75] Inventors: Jacques Zurbuchen, Kaiseraugst; Paul Dussy, Basel, both of Switzerland

[73] Assignee: Ciba-Geigy Corporation, Ardsley, N.Y.

[21] Appl. No.: 49,711

[22] Filed: Jun. 18, 1979

Related U.S. Application Data

[63] Continuation of Ser. No. 864,897, Dec. 27, 1977, abandoned.

[51] Int. Cl.[3] ..... D06P 1/00; C09B 27/00

[52] U.S. Cl. ..... 8/638; 8/475; 8/639; 8/922

[58] Field of Search ..... 8/25, 26, 179, 638, 8/639, 922

[56] References Cited

U.S. PATENT DOCUMENTS 3,989,449 11/1976 Dixon et al. ..... 8/25

FOREIGN PATENT DOCUMENTS 2256116 5/1973 Fed. Rep. of Germany .
1116681 5/1956 France .

OTHER PUBLICATIONS

Weingarten, R., Textilpraxis International, 1973, pp. 231–233.
Weigold, S., Spinner Weber Textilveredlung, 1967, 77, pp. 35–41.
Merian, E. et al., J. Soc. Dyers and Colourists, 1963, 79, (No. 11), pp. 505–512.
Cegarra, J., et al., Textilveredlung, 1972, 7, (No. 7), pp. 433–439.
Moncrieff, R. W., "Man-Made Fibres" (John Wiley, 1975) pp. 453 and 887–888.

*Primary Examiner*—A. Lionel Clingman
*Attorney, Agent, or Firm*—Edward McC. Roberts

[57] ABSTRACT

Described is a process for the level dyeing of polyester material by the aqueous exhaust method at temperatures above 100° C., which comprises the use of an aqueous dye liquor which contains at least one migrating disperse dye as well as further ingredients. As migrating disperse dye, preferably a dye is used which has a diffusion coefficient Do at 130° C. of 2 to $10\times10^{-10}$ $cm^2/sec$, a distribution coefficient K at 130° C. of 20 to 500 1/kg, and a migration half-life t/2 less then 50 minutes.

8 Claims, No Drawings

PROCESS FOR THE LEVEL DYEING OF POLYESTER MATERIAL

This is a continuation of application Ser. No. 864,897, filed on Dec. 27, 1977, now abandoned.

The invention relates to a process for the level dyeing of polyester material using specific disperse dyes, to the dye liquor suitable for carrying out said process, and to the dyed polyester material obtained by this process.

It is known to dye polyester material by the exhaust method, in particular under high temperature conditions, from an aqueous liquor. The drawback of this known method is that unlevel dyeings are often obtained, especially on wound packages. To obtain level dyeings, especially in bright shades, the heating phase of the bath is critical. A slow, controlled heating and a good circulation must be ensured, to which end specific machines are necessary. Once unlevel dyeings have been obtained, the unlevelness can hardly be rectified even by keeping the dyebath at 130° C. for a prolonged period of time.

To obtain level dyeings on polyester material it is therefore necessary that the control of the increase in temperature in the heating phase must be effected subject to specific exhaustion characteristics of the disperse dyes employed; and machine-related conditions, such as liquor circulations, have to be included in complicated and elaborate calculations.

To avoid these difficulties, the proposal has already been made to add specific, in particular non-ionic, dyeing assistants to the dyebath. Not infrequently, however, these assistants have the drawback that they adversely affect the stability of the dyestuff dispersion in the heating phase, which in turn can result in unlevel dyeings.

All these methods consequently do not solve the problem of the level dyeing of polyester material in a satisfactory manner.

Surprisingly, it has now been found that the disadvantages initially referred to, in particular complicated calculations for carrying out the dyeing, such as the heating phase and the circulation rate, can be eliminated by dyeing polyester material with migrating disperse dyes having specific physicochemical properties.

Accordingly, the process of the present invention for dyeing polyester material from an aqueous liquor by the exhaust method at temperatures above 100° C. comprises the use of a liquor which contains at least one migrating disperse dye and further ingredients.

Suitable migrating disperse dyes are in particular those having a diffusion coefficient Do at 130° C.—measured by the densitometric method [Melliand Textilberichte 55, 463–467 (1974)]—of 2 to 10, preferably 2.5 to $10\times10^{-10}$ cm²/sec, and a distribution coefficient K at 130° C. of 20 to 500, preferably of 60 to 350, l/kg.

Particularly suitable migrating disperse dyes are those which have a migration half-life t/2 of less than 50, preferably less than 30, minutes. The migration half-life t/2 is the time in which the undyed polyester material, which is treated together with a dyed piece of the same material of equal size at 130° C. in an aqueous liquor, is so dyed that the amount of dye it contains is 50% of the amount of the dyed material.

Suitable disperse dyes which fulfill these conditions are, from a chemical point of view, those which belong to the widest classes of disperse dyes. They are, for example, dyes which do not contain sulphonic acid groups and which are only sparingly soluble in water at room temperature, such as quinophthalone dyes, nitro dyes, methine dyes, naphthoquinonimine, dyes, styryl dyes, azostyryl dyes, naphthoperinone dyes and, in particular, anthraquinone and azo dyes, such as mono- and disazo dyes.

The dyeings obtained with these migrating disperse dyes unexpectedly show a good fastness to sublimation, especially in bright shades, i.e. in those shades which have a reference type strength of $\leqq\frac{1}{2}$.

Particularly good results, chiefly based on a dichromatic or trichromatic system, are obtained with the following dyes:

YELLOW DYES

| | |
|---|---|
| 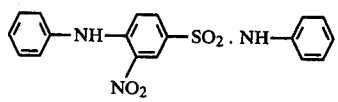 | Do = 3,7<br>K = 152<br>t/2 = 35 |
| 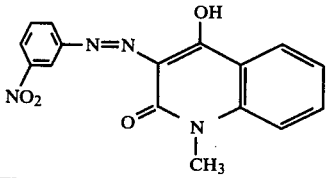 | Do = 6,0<br>K = 193<br>t/2 = 17 |

RED DYES

| | |
|---|---|
| 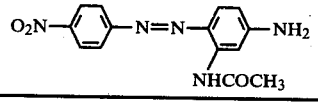 | Do = 5,0<br>K = 81<br>t/2 = 25 |

BLUE DYES

| | |
|---|---|
| CI Disperse Blue 26 (methylated mixture of diaminoanthrarufine and diaminochrysazine) | Do = 4,8<br>K = 315<br>t/2 = 22 |
| CI Disperse Blue 95 (mixture of diaminoanthrarufine and diaminochrysazine treated with formaldehyde) | Do = 4,8<br>K = 315<br>t/2 = 22 |

These dyes have a sufficiently high rate of diffusion, which thus permits level dyeings to be obtained via the migration. A trichromatic system of migrating disperse dyes is therefore available. By a trichromatic system is meant a mixture which contains a blue, a red and a yellow dye.

The determination of the distribution coefficient K is made according to the formula $$K = \frac{V \cdot Az}{1 - Az}$$

wherein Az denotes the degree of exhaustion and V denotes the liquor ratio (the number of liters of liquor per kg of material, Textilpraxis inter. 1973, 231–233), the K value being determined at a liquor ratio of at least 100:1 on Crimplene® (ICI).

Depending on the desired depth of shade, the amounts in which the migration disperse dyes are used in the dyebaths can vary within wide limits. In general, amounts from 0.001 to 10, preferably 0.01 to 2, percent by weight of one or more of the above disperse dyes, based on the weight of the polyester material, are advantageous. The dyes are known and can be obtained by methods known in the art.

Further ingredients which are added to the aqueous dye liquor are in particular acids and salts, such as formic and acetic acid, as well as ammonium sulphate for adjusting an optimum pH value, and dispersants, especially anionic dispersants.

Suitable anionic dispersants are for example: sulphated primary or secondary, purely aliphatic alcohols containing 8 to 18 carbon atoms in the alkyl chain; for example sodium laurylsulphate, or the sodium salts of coconut fatty alcohol sulphates; sulphated unsaturated higher fatty acids or fatty acid esters, such as the sulphates of oleic acid, elaidic acid or ricinolic acid and the lower alkyl esters thereof, and the oils which contain such fatty acids, such as olive oil, castor oil, colza oil; the adducts of 1 to 20 moles of ethylene oxide with fatty amines, fatty acids or aliphatic alcohols containing 1 to 18 carbon atoms in the alkyl chain, which have been converted into an acid ester with an organic dicarboxylic acid, such as maleic acid, malonic acid or succinic acid, but preferably with an inorganic polyacid, such as o-phosphoric acid or, in particular, sulphuric acid, for example the acid sulphuric acid ester of the adduct of 2 moles of ethylene oxide with 1 mole of p-nonylphenol; sulphated esterified polyoxy compounds, for example sulphated, partially esterified polyhydric alcohols, such as the sodium salt of the sulphated monoglyceride of palmitic acid; primary and secondary alkylsulphonates containing 8 to 20 carbon atoms in the alkyl chain, for example ammonium decylsulphonate, sodium dodecylsulphonate, sodium hexadecanesulphonate, sodium stearylsulphonate; alkylarylsulphonates, such as alkylbenzenesulphonates with straight or branched alkyl chain containing at least 7 carbon atoms, for example sodium dodecylbenzenesulphonate; sulphonates of polycarboxylic acid esters, for example sodium dioctylsulphosuccinate; the sodium, potassium, ammonium, N-alkyl, N-hydroxyalkyl, N-alkoxyalkyl or N-cyclohexylammonium or hydrazinium and morpholinium salts of fatty acids containing 10 to 20 carbon atoms which are termed soaps, for example of lauric, palmitic, stearic or oleic acid, of naphthenoic acids, of resinic acids, such as abietic acid, for example the so-called colophonium soap.

Particularly suitable anionic dispersants are ligninsulphonates and polyphosphates as well as condensation products of aromatic sulphonic acids with formaldehyde, such as condensation products of formaldehyde and naphthalenesulphonic acids, for example the disodium salt of di-(6-sulphonaphthyl-2)-methane, or of formaldehyde, naphthalenesulphonic and benzenesulphonic acid, or a condensation product of crude cresol, formaldehyde and naphthalensulphonic acid.

However, it is also possible to use mixtures of anionic dispersants. The anionic dispersants are usually in the form of their alkali metal salts, ammonium salts, or of their water-soluble amine salts.

Suitable textile materials are polyester materials and cellulose triacetate fabrics. By polyester materials are meant polycondensates of aromatic polycarboxylic acids, especially dicarboxylic acids or derivatives thereof, and polyfunctional alcohols, in particular glycols. The polyester used hitherto almost exclusively in the textile industry consists of terephthalic acid and ethylene glycol.

Copolymers of terephthalic acid and isophthalic acid with ethylene glycol as well as modified polyester materials can also be used, for example those which can be dyed without a carrier at 100° C. These materials can be in the most diverse stages of processing, for example in the form of piece goods, such as woven and knitted fabrics, and of yarn in the form of wound packages or muffs.

The dyeing process of the present invention can be carried out in all kinds of closed and, advantageously, pressure-resistant machines, for example in jet dyeing machines and winch becks, in circulating-liquor machines, such as circulating machines for cheeses and muffs, and in beam dyeing machines.

The dyeing process consists in putting the textile material at a temperature of about 70° to 90° C. into the aqueous liquor which contains the further ingredients, keeping the liquor for about 5 minutes at this temperature and then heating it, preferably continuously, in the course of 15 to 25 minutes to a temperature of above 100° C. to 140° C. The liquor is kept for about 30 to 120 minutes, preferably for 60 minutes, at this temperature. The temperature at which the dye in question is added to the liquor is not critical. The preferred dyeing temperature is in the range between 110° and 140° C. A liquor circulation can be carried out from the outside to the inside of the material or conversely and alternating.

The dyeing is aftertreated by cooling the dyebath to about 80° C., rinsing the goods with water, followed, if required, by a reductive afterclear, and drying them.

The process of the present invention consequently differs from known processes which use no or only moderately migrating disperse dyes in the shortened heating phase and in the possibility of adding the dye to the liquor at any temperature. Because of the good migration of the dyes, a certain unlevelness with the dyes exhaust onto the material is entirely permissible, since this unlevelness can be rectified in the dwell at the dyeing temperature.

The process is carried out at a liquor ratio of especially 1:4 to 1:100, preferably 1:10 to 1:50, by which is meant the ratio of goods (in kg) to liquor (in liters).

The dyeing process using at least one of the migrating disperse dyes as defined herein permits:

an uncontrolled heating of the liquor to dyeing temperature without taking particular account of the significant or critical dyeing rate (see Melliand 10, 1974, pp 876–879), so that complicated programmings and calculations are not necessary;

a pronounced migration of the disperse dyes under HT conditions;

the production of level individual and especially compound shade dyeings, with good coverage of barriness;

a simple, rational and safe operation;

a simple correction of faulty dyeings, since a better adjustment takes place;

carrying out the process without the addition of carriers and levelling agents;

a shading under conventional HT conditions on account of the very good migration of the disperse dyes as defined herein;

the production of very level dyeings—even when using dye mixtures—which have good fastness properties.

Finally, unlevel dyeings, even those which differ in depth of shade and occur in particular on rapid and uncontrolled heating, are rectified in the subsequent dwell of the textile material in the liquor, so that level dyeings are obtained.

By means of the process of this invention it has been possible to solve an old problem in a novel and technically simple manner which is substantially more reliable than the hitherto known processes and which requires the usual amount of time. This process is particularly suitable for obtaining bright and very bright shades.

The following Examples serve to illustrate the invention. The levelling action of the dyes was tested by treating polyester material dyed with the migrating disperse dyes as defined herein with undyed polyester material under HT conditions. In this test, the dyes migrate in a more or less pronounced manner from the dyed to the undyed material.

EXAMPLE 1

700 g of polyester texturised yarn in muff form are dyed in a HT circulating-liquor dyeing machine under HT conditions in the conventional manner in a liquor ratio of 1:10 with the following dyes:

0.69 g of the yellow dye of the formula

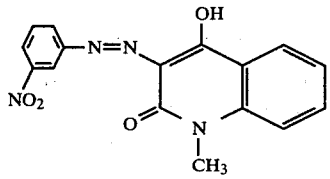

Do = 6,0
K = 193
t/2 = 17

0.69 g of the red dye of the formula

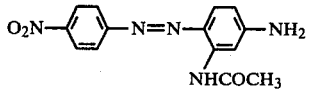

Do = 5,0
K = 81
t/2 = 25

1.10 g of the blue dye

| | |
|---|---|
| CI Disperse Blue 26 (methylated mixture of diaminoanthrarufine and diaminochrysazine) | Do = 4,8<br>K = 315<br>t/2 = 22 |

The dyeing was aftertreated in the usual manner (dyeing 1).

A further dyeing (dyeing 2) is carried out on 700 g of texturised yarn in muff form as described above using the same dyes, but in smaller amounts, viz.:

0.29 g of the yellow dye.
0.29 g of the red dye and
0.475 g of the blue dye mixture.

The material is also subjected to an aftertreatment in the same manner. Both dyeings 1 and 2, which differ in their colour strength by about 40%, are treated in a HT circulating-liquor dyeing machine in a liquor ratio of 1:10 with a blank aqueous liquor containing 28 g of the disodium salt of di-(6-sulphonaphthyl-2)-methane, 28 g of ammonium sulphate and 7 ml of 80% aqueous formic acid. The blank dyebath is heated from 95° to 130° C. in the course of 10 minutes and allowed to circulate from the outside to the inside of the circulating pump direction for 75 minutes. The liquor is cooled to 80° C., and the goods are rinsed and finished in the usual manner.

Two polyester muffs (wound packages) dyed in a level olive green shade are obtained. Yarn was taken alternatively from the outside, centre and inner layer of the two muffs and used to form a knitted piece which exhibited a completely level shade.

It is thus evident that dyeing 1 and dyeing 2, which differ from each other by about 40% in colour strength before the treatment, are rectified by the migration and give hand-knitting yarns which are dyed in completely level shades.

EXAMPLE 2

The procedure described in Example 1 is repeated, except that dyeings 1 and 2 are treated for 35 minutes at 135° C. instead of for 75 minutes at 130° C. An equally complete colour rectification of the originally differing dyeings is achieved.

EXAMPLE 3

1400 g of texturised polyester in the form of a wound package are treated in a HT circulating-liquor dyeing machine in a liquor ratio of 1:15 with an aqueous liquor containing 21 g of the disodium salt of di-(6-sulphonaphthyl-2)-methane, 42 g of ammonium sulphate and 10.5 ml of 80% aqueous formic acid at a temperature of 70° C. In the tank for liquor preparation, the mixture of the following dyes:

1.96 g of the yellow dye of the formula given in Example 1,
1.96 g of the red dye of the formula given in Example 1,
3.15 g of the blue dye of the formule given in Example 1, is drawn in water into the liquor circulation and the liquor is allowed to circulate for 5 minutes at 70° C. The liquor is heated to 130° C. in the course of 20 minutes and a rate of about 3 circulations per minute and kept at this temperature for 60 minutes. The dyebath is then cooled to 80° C. and the goods are rinsed and aftertreated in the usual manner.

A knitted piece obtained by knitting separately the outside, centre, and inner layers of the resulting olive green polyester texturised yarn (muff) is dyed in a completely level shade and the individual layers can virtually no longer be distinguished.

EXAMPLE 4

The procedure of Example 3 is repeated, heating with a capacity of 3° C. per minute, but in this case to a bath temperature of 135° C. and keeping this temperature for 30 minutes. A texturised yarn dyed in a level olive green shade is also obtained. On knitting separately the outside, centre, and inner layers of the muff to a knitted piece, no differences in colour strength can be observed.

EXAMPLE 5

Comparison Example using non-migrating dyes.

The procedure of Example 3 is repeated, using a mixture of the following dyes:

0.2 g of the yellow dye mixture of the formulae

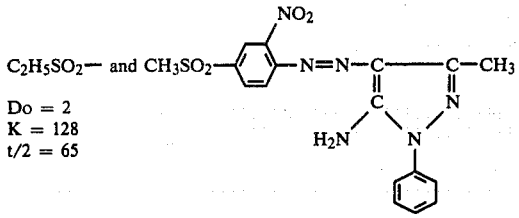

Do = 2
K = 128
t/2 = 65

0.2 g of the red dye of the formula

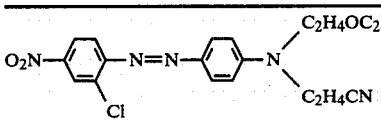

Do = 2,4
K = 191
t/2 = 53

0.27 g of the blue dye mixture of the formulae

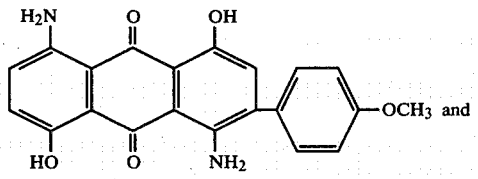

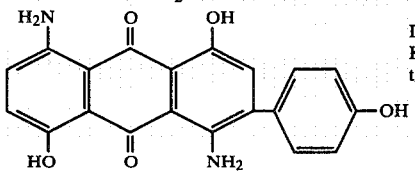

Do = 2,9
K = 700
t/2 = >60

Polyester texturised yarn dyed in an eggshell shade is obtained.

On knitting separately the outside, centre, and inner layers of the polyester texturised yarn to a knitted piece, darker and lighter differences in colour are observed which point to unlevelness in the muff and which cannot be substantially improved even by a prolonged treatment at 130° C. for a total of 120 minutes. The unlevelness is caused by the poorly migrating dyes, especially by the blue one.

EXAMPLE 6

The procedure of Example 3 is repeated, using instead of the dyestuff mixture indicated therein 3 g of the individual dye of the formula

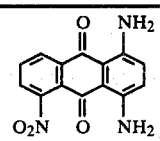

Do = 6
K = 49,4
t/2 = 36

After knitting the material, a knitted piece dyed in a level violet shade is obtained.

By using 3 g of the dye of the formula

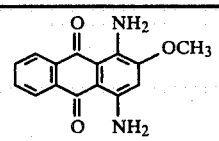

Do = 10
K = 68
t/2 = 14 instead of the dye of the formula I, a knitted piece dyed in a level pink shade is obtained after knitting.

In the course of the dyeing procedure, 0.05 g of the violet dye of the formula I can be added to this pink dyeing after about 15 minutes at 130° C. Dyeing is then continued for a further 45 minutes at 130° C. Levelly dyed hand-knitting yarns and a bluer pink shade are obtained.

EXAMPLES 7 to 12

The procedure of Example 3 is repeated, but using instead of the dyestuff mixture indicated therein the dyes listed in the following table in the indicated amounts. After knitting a knitted piece levelly dyed in the shades stated in the last column of the table is obtained.

| Example | Dye | | Amount (g) | Shade on polyester |
|---|---|---|---|---|
| 7 | 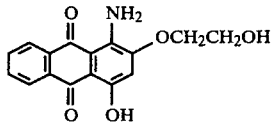 | K = 54<br>Do = 4,9<br>t/2 = 29 | 1 | pink |
| 8 | 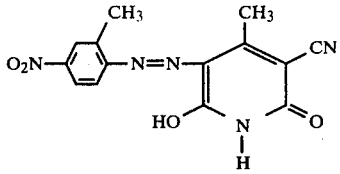 | K = 69<br>Do = 2,8<br>t/2 = 40 | 1,5 | yellow |
| 9 | 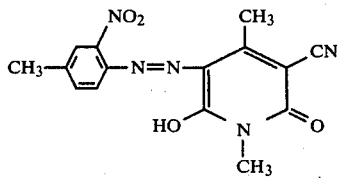 | K = 443<br>Do = 2,7<br>t/2 = 30 | 1,5 | yellow |

-continued

| Example | Dye | | Amount (g) | Shade on polyester |
|---|---|---|---|---|
| 10 | 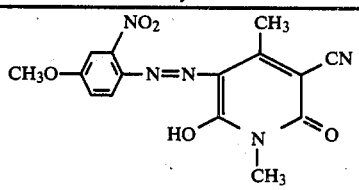 | K = 263<br>Do = 2,7<br>t/2 = 25 | 1,5 | orange |
| 11 | 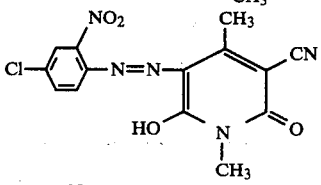 | K = 204<br>Do = 3,5<br>t/2 = 30 | 1,5 | yellow |
| 12 | 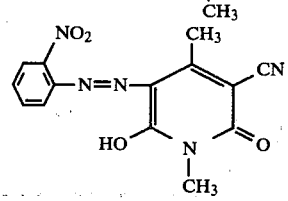 | K = 120<br>Do = 4,1<br>t/2 = 25 | 1,5 | slightly greenish yellow |

EXAMPLE 13

(Comparison Example)

700 g of texturised polyester yarn in muff form are dyed in a HT circulating-liquor machine under HT conditions in the usual manner in a liquor ratio of 1:10 with the following dyes:

0.7 g of the yellow dye of the formula

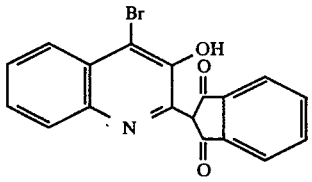

K <2000
Do = 4,2
t/2 <60

1 g of the red dye of the formula

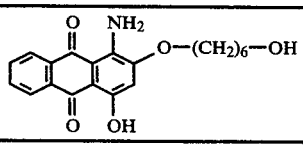

K 500
Do = 5.0
t/2 <60 min 1.6 g of the blue dye of the formula

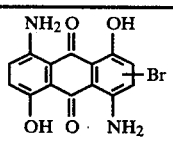

K 2020
Do = 4,8
t/2 <60 min

The dyeing is aftertreated in the usual manner. An undyed polyester muff (700 g) and the above muff, which is dyed in a light grey shade, are treated together in a circulating-liquor machine in a liquor ratio of 1:10 with a blank liquor containing 28 g of di-(6-sulphonaphthyl-2)-methane, 28 g of ammonium sulphate and 7 ml of 80% aqueous formic acid. The liquor is heated to 95°-130° C. in the course of 10 minutes and allowed to circulate for 60 minutes from outside to the inside of the circulating pump direction, then cooled to 80° C. The goods are rinsed and aftertreated in the usual manner.

After the treatment in the blank liquor, the depth of shade of the originally dyed polyester muff has only been insignificantly brightened. The undyed muff has only a very slight light grey colouration after the treatment.

On processing the inner, centre and outer layers of the muff separately to a knitting in stocking form, the individual layers have a completely unlevel colouration which differs in shade from layer to layer. It is evident that the dye of the previously dyed muff migrated unlevelly and only in small amount to the white, undyed muff.

By repeating the above procedure, but using instead the trichromatic system of Example 1, then, after knitting the individual layers of the muff, a knitted piece is obtained which has no deviations in shade. In addition, the undyed muff has the same depth of shade as the dyed muff. This means that a complete rectification of the dyeings on both muffs is obtained by a trichromatic dyeing using migrating dyes.

What is claimed is:

1. In a process for the level dyeing of polyester material by the exhaustion of three or more disperse dyes from an aqueous liquor at a temperature above 100° C., the improvement wherein all of the selected disperse dyes are migrating disperse dyes, having a diffusion coefficient Do at 130° C. of 2 to $10\times10^{-10}$ cm²/sec, a distribution coefficient K at 130° C. of 20 to 500 1/kg, and a migration half-life t/2 of less than 50 minutes.

2. An aqueous dye liquor comprising no non-migrating dyes and at least three migrating disperse dyes, having a diffusion coefficient Do at 130° C. of 2 to $10\times10^{-10}$ cm²/sec, a distribution coefficient K at 130° C. of 20 to 500 1/kg, and a migration half-life t/2 of less than 50 minutes.

3. Polyester material, dyed with at least three migrating disperse dyes, having a diffusion coefficient Do at 130° C. of 2 to $10\times10^{-10}$ cm²/sec, a distribution coefficient K at 130° C. of 20 to 500 1 kg, and a migration half-life t/2 of less than 50 minutes, in the absence of any non-migrating dyestuff.

4. A process according to claim 1 wherein at least one of the disperse dyes has a diffusion coefficient Do at 130° C. of 2.5 to $10\times10^{-10}$ cm²/sec, a distribution coefficient K at 130° C. of 60 to 350 1/kg, and a migration half-life t/2 of less than 30 minutes.

5. A process according to claim 2 wherein the dyes constitute a trichromatic system of migrating disperse dyes.

6. A process according to claim 1 wherein the dyes are two or more of the following migrating disperse dyes:

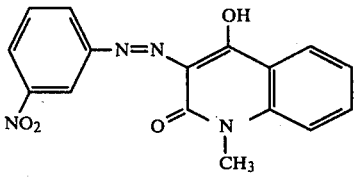

Do = 6,0
K = 193
t/2 = 17

-continued

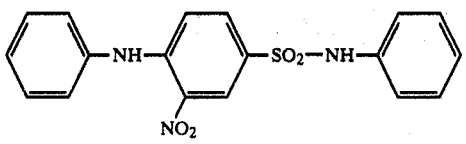

Do = 3,7
K = 152
t/2 = 35

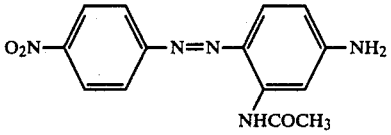

Do = 5,0
K = 81
t/2 = 25

| | |
|---|---|
| CI Disperse Blue 26 | |
| (methylated mixture of diaminoanthrarufine and diaminochrysazine | Do = 4,8<br>K = 315<br>t/2 = 22 |
| CI Disperse Blue 95 | |
| (mixture of diaminoanthrarufine and diaminochrysazine, treated with formaldehyde) | Do = 4,8<br>K = 315<br>t/2 = 22 |

7. A process according to claim 1 wherein the aqueous liquor contains no carrier.

8. A process according to claim 1 wherein the temperature is between 110° and 140° C. under pressure.

* * * * *